US005272604A

United States Patent [19]

Lin

[11] Patent Number: 5,272,604

[45] Date of Patent: Dec. 21, 1993

[54] CYCLONIC LIQUID ORNAMENT

[76] Inventor: Rich Lin, No. 185, Dah Guan Rd. Sec. 2 Pan Chiao, Taipei Hsien, Taiwan

[21] Appl. No.: 871,512

[22] Filed: Apr. 21, 1992

[51] Int. Cl.[5] ..... F21V 33/00

[52] U.S. Cl. ..... 362/96; 362/101; 362/806; 40/406; 40/409; 428/13

[58] Field of Search ..... 362/101, 96, 806; 428/13; 40/406, 409, 439, 441; 366/314, 263; 434/217; 210/512.1, 512.3, 360.1; 494/10, 50, 52

[56] References Cited

U.S. PATENT DOCUMENTS

| | | | |
|---|---|---|---|
| 1,681,040 | 8/1928 | Kemp | 362/101 X |
| 2,709,217 | 5/1955 | McCluskey | 362/101 |
| 3,060,702 | 10/1962 | Price, Jr. | 366/314 |
| 3,613,264 | 10/1971 | Vitka et al. | 40/406 |
| 3,635,448 | 1/1972 | Okada | 366/314 |
| 4,258,912 | 3/1981 | Reighart II | 434/217 |
| 4,490,931 | 1/1985 | Fleemin | 40/406 |
| 4,582,498 | 4/1986 | Tamada | 40/406 |
| 4,784,634 | 11/1988 | Schiele | 494/52 |
| 4,817,311 | 4/1989 | Ong | 428/13 X |
| 4,831,757 | 5/1989 | Sheehan | 40/406 |
| 4,852,283 | 8/1989 | Teng | 428/13 X |
| 5,028,318 | 7/1991 | Aslin | 210/512.1 |
| 5,128,033 | 7/1992 | Eberhardt | 210/512.3 |
| 5,146,701 | 9/1992 | Lee | 40/406 |

*Primary Examiner*—Richard R. Cole
*Attorney, Agent, or Firm*—Bacon & Thomas

[57] ABSTRACT

A vessel filled with two liquids of different specific gravities is provided with a centrifugal impeller for creating a vortex from the liquid of lesser specific gravity to simulate a cyclone. Ornaments may be disposed within the vessel for generating additional visual effects during the formation of the vortex.

8 Claims, 8 Drawing Sheets

CYCLONIC LIQUID ORNAMENT

BACKGROUND OF THE INVENTION

If we look at a general liquid ornament as shown on FIG. 1, you can see a transparent vessel charged with two different liquids having incompatible specific gravities. A floating object is placed at the boundary surface. The form of the floating object could be a sailboat, surfer, surfboard or soda can, or others, etc. The boundary surface will generate ripple while shaking this transparent vessel and the floating object will produce a dynamic performance immediately. However, these type of liquid ornaments need to be shaken by our hands to produce dynamic performance and the ripples generated at boundary surface can only last a short period of time. Temporary visual enjoyment effect is their disadvantage. Also, we can find some other liquid ornaments constructed as a clepsydra. These are three partitions partitioned inside the transparent vessel and charged with bi-liquid. The heavier liquid will sink down at bottom and will fall down drop by drop from top to the bottom when it is placed up side down. It can demonstrate liquid's viscous characteristic and incorporate visual enjoyment effect, furthermore, spiral rail or impeller, etc., optional devices are sometimes installed inside the vessel, so the ball-shape liquid drop will follow the spiral rail and roll down to the bottom or strike the impellers to revolve the impeller and increase the amusement effect. Same as other liquid ornament, their dynamic performance can not last very long.

It only last for 1, or 2 minutes, sometimes even shorter, and a water-drop shaped liquid effect can be achieved is its demerits. Meanwhile, general liquid ornaments mainly focus on the characteristic demonstration of clepsydra effect or different liquids having respective specific gravities for sundry items of ornament, and somehow another characteristics of liquid has been ignored, for instance, the generation of vortex after stirring the liquid. It presents another type of enjoyment.

The inventor of this creation came up with these ideas mentioned earlier in this section and devoted himself to design and development. Finally, the said invention is developed after a long period of effort. The primary purpose of this invention is to install a centrifugal impeller assembly inside the transparent vessel and have it suck the lighter liquid of the bi-liquid to form a vortex, just like a cyclone, so visual enjoyment is prominent.

The secondary purpose of this invention is to use the vortex to revolve the floating object which is placed inside the transparent vessel and provided with light reflection features. The floating object can reflect light emitted by a light bulb and projected on the floating object, just like stage lights to produce a splendid effect. Additional purpose of this invention is to acquire more fun and dynamic performance effect by using a speed-adjustable centrifugal impeller to control the tail length of the vortex.

SUMMARY OF THE INVENTION

The mechanism design of the said cyclonic liquid ornament is peculiarly confined to the cyclonic formation of light liquid inside the bi-liquid charged transparent vessel through the aid of revolving centrifugal impellers. The centrifugal impellers are installed at proper distance eccentric to the center of this transparent vessel; and there's a partition board equipped to the impeller having a suction intake alinged with impellers. There're several discharge outlets peripherally positioned on the partition board. The lighter liquid inside the bi-liquid charged transparent vessel will be sucked to form a cyclone when centrifugal impellers are revolving due to its light specific gravity.

DESCRIPTION OF THE PREFERRED EMBODIMENT

Figure 1:
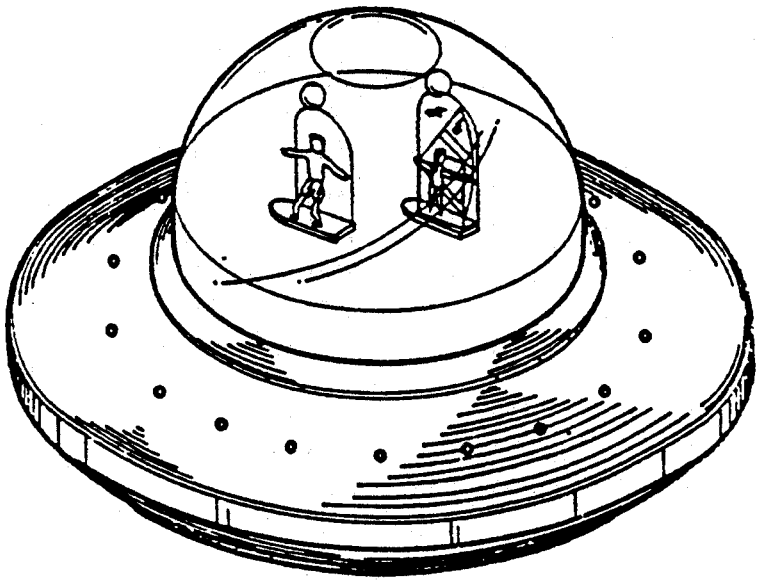
FIG 1 PRIOR ART
FIG. 1 Prior Art liquid ornament
FIG. 2 Section view of this invention
FIG. 3 Three-dimensional view of this invention
FIG. 4 Practical Example of this invention I
FIG. 5 Practical Example of this invention II
FIG. 6 Practical Example of this invention III
FIG. 7 Reference Practice of this invention I
FIG. 8 Reference Practice of this invention II
Figure 2:
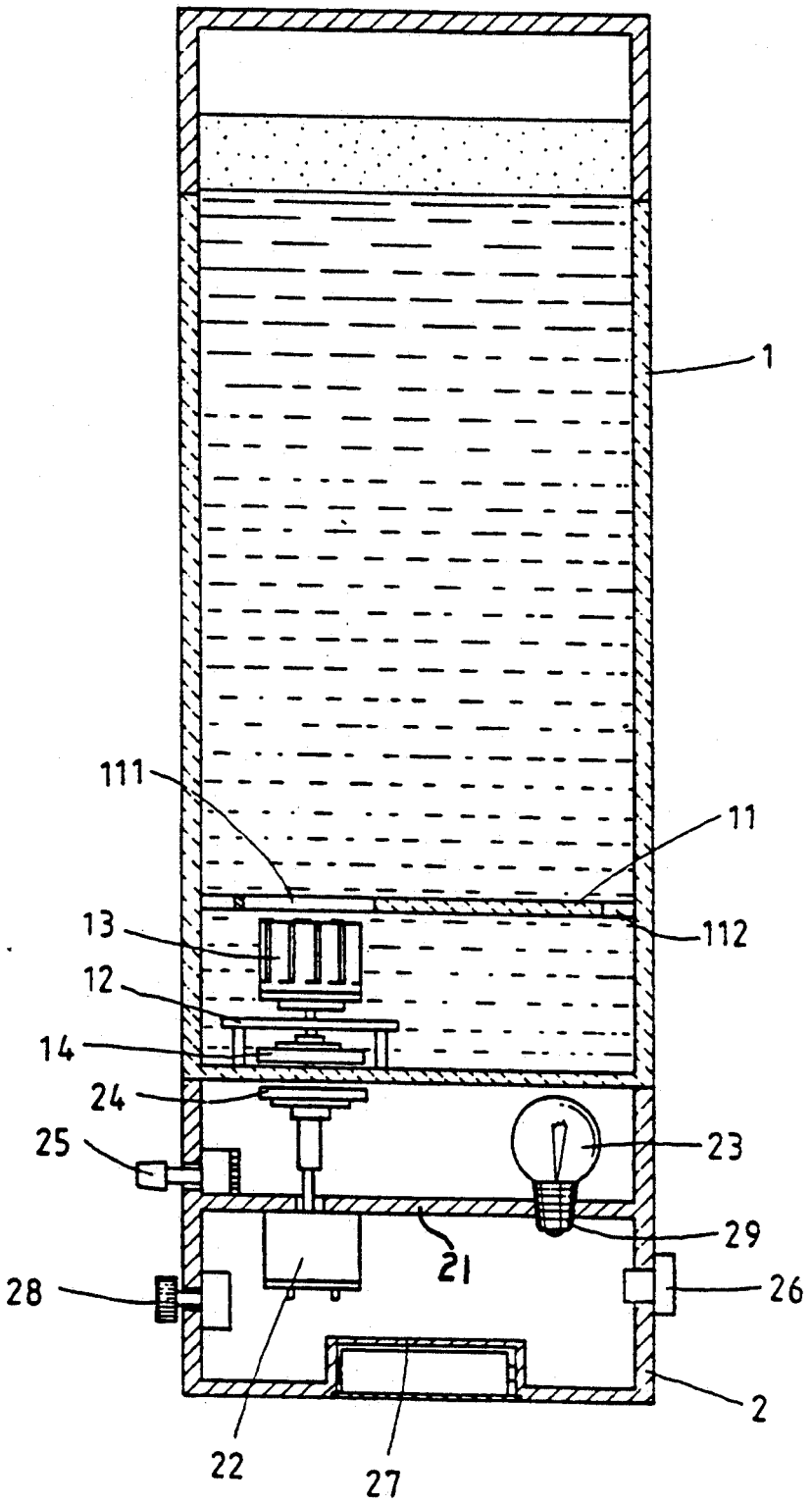

Please refer to FIG. 2 the section view of this invention comprised of a transparent vessel (1) and base seat (2); the relevent position and assembly are described below:

The transparent vessel (1) is charged with bi-liquid, the lighter liquid will float inside the vessel, a partition board (11) is installed at proper position close to the bottom of the vessel interior and an impeller bracket (12) is placed at a proper distance eccentric to the center of the vessel and below the partition baord (111); the bracket can support the centrifugal impeller (13). There's a suction intake (11) on the partition board (11) and a plurality of discharge outlets (112) peripherally positioned around board (13) a magnetic iron (14) is equipped to the entrance end of the centrifugal impeller (13).

Base seat (2) has a retainer (21) where motor (22) and light bulb (23) are fixed. There's a magnetic iron (24) installed on the output axle of the motor that can actuate centrifugal of impeller (13) through magnetic iron (14) rotation when motor is energized to revolve. Also a switch (25), external power plug (26), cell box (27), variable resistance (28) and light bulb holder (29) are installed at proper locations of the base seat (2) and serve as the necessary electric circuit of this invention.

Figure 3:
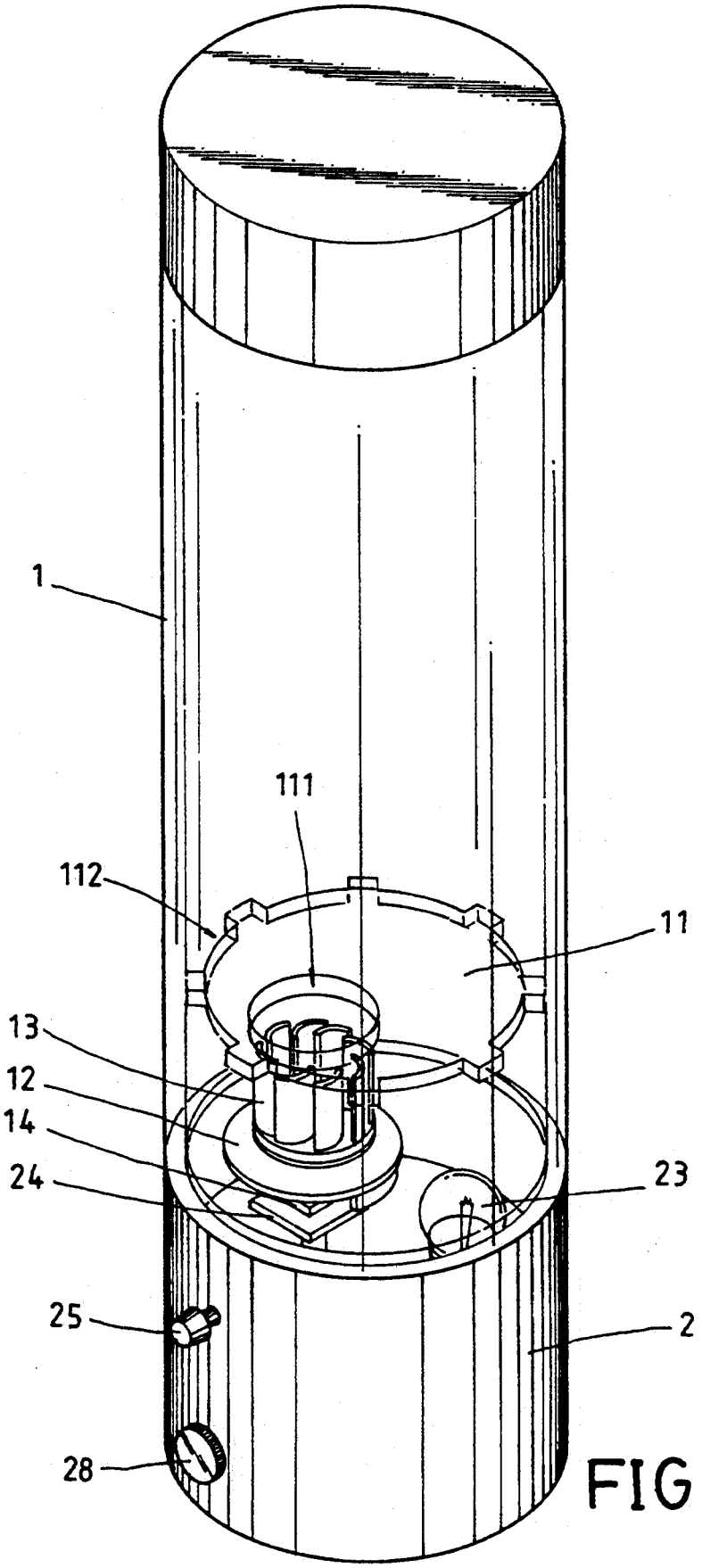

If we review the actual practice of this invention based on the structure mentioned earlier as shown on FIG. 3, the magnetic iron (24) will start its rotation simultaneously with operation of motor revolution, consequently, the magnetic iron (14) installed on centrifugal impeller (13) will be drawn to rotate by the magnetic iron (24); meanwhile, centrifugal impeller (13) will begin to rotate. At this moment, bi-liquid will be stirred and drawn to form a vortex by the rotation given from centrufugal impeller (13) as if it were a cyclone, and the liquid having lighter specific gravity will produce an enhanced effect after been dyed. The rotation of the centrifugal impeller shown on FIG. 2 is to utilize the magnetic force given out from magnetic iron (14) and (24) to connect axles of motor (22) and centrifugal impeller (13) which rotate the impeller. The magnetic force given out from magnetic iron (14) and (24) have been correctly designed and calculated to rotate the centrifugal impeller (13). Also, centrifugal impeller (13) can be directly driven. by motor (22); however, additional sealing devices, such as a gland packing must be provided above the vessel (1).

The purpose of the eccentricity of the centrifugal impeller (13) is to deviate the tail end of the vortex from center of the vessel (1) so that the formed vortex can demonstrate an active motion, not an unvarying form, so it acts just like it were a real cyclone.

Figure 4:
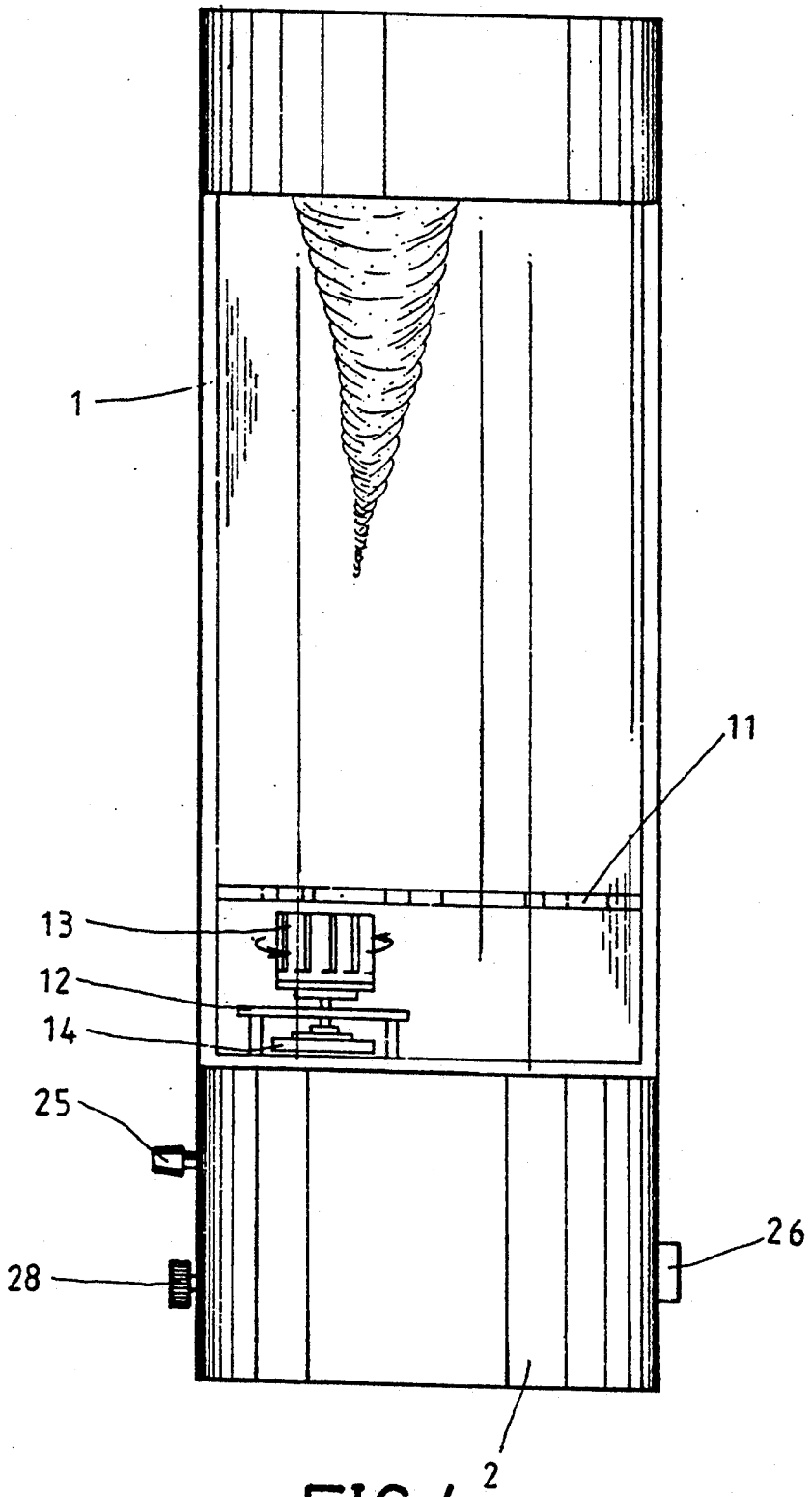
Figure 5:
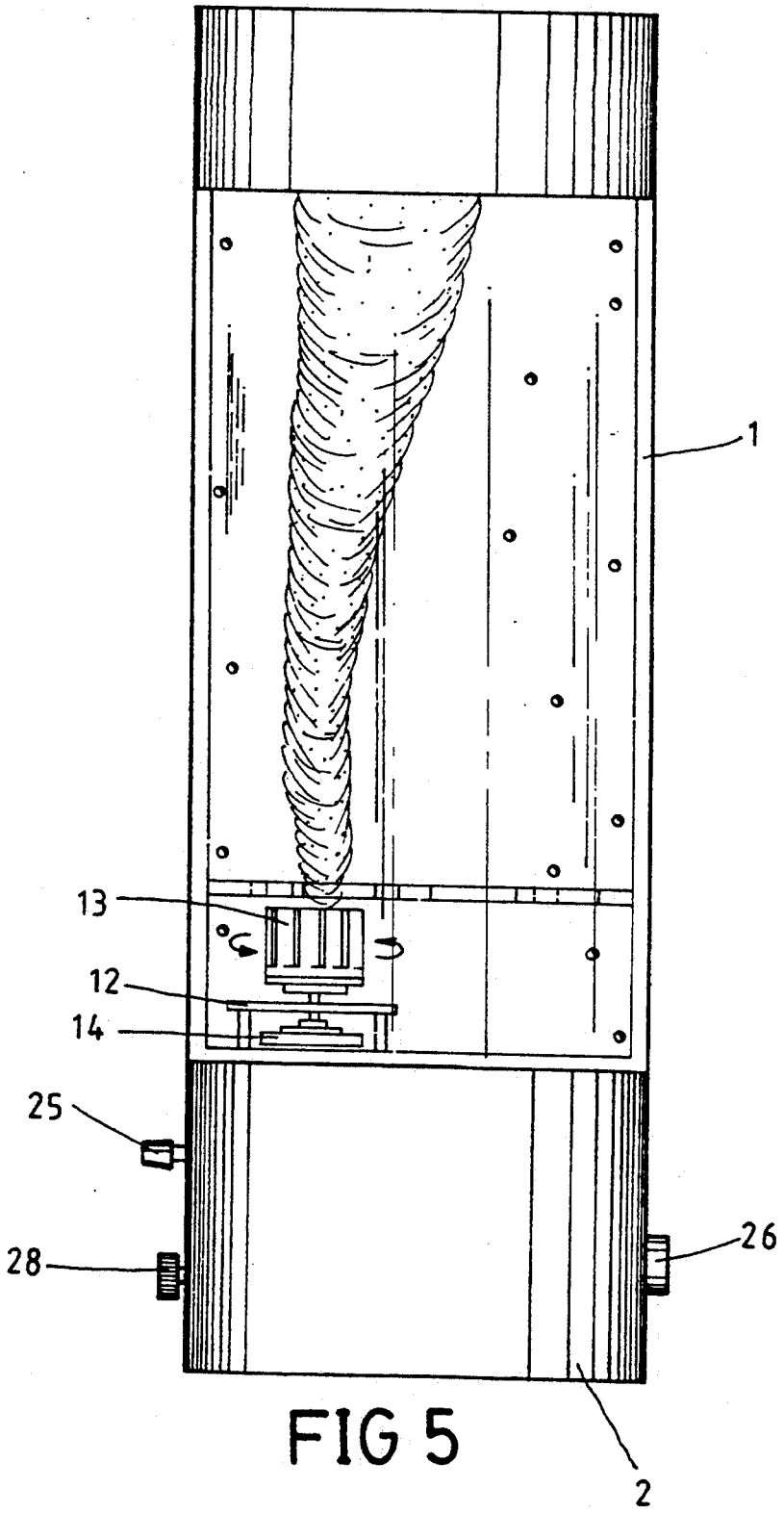
Figure 6:
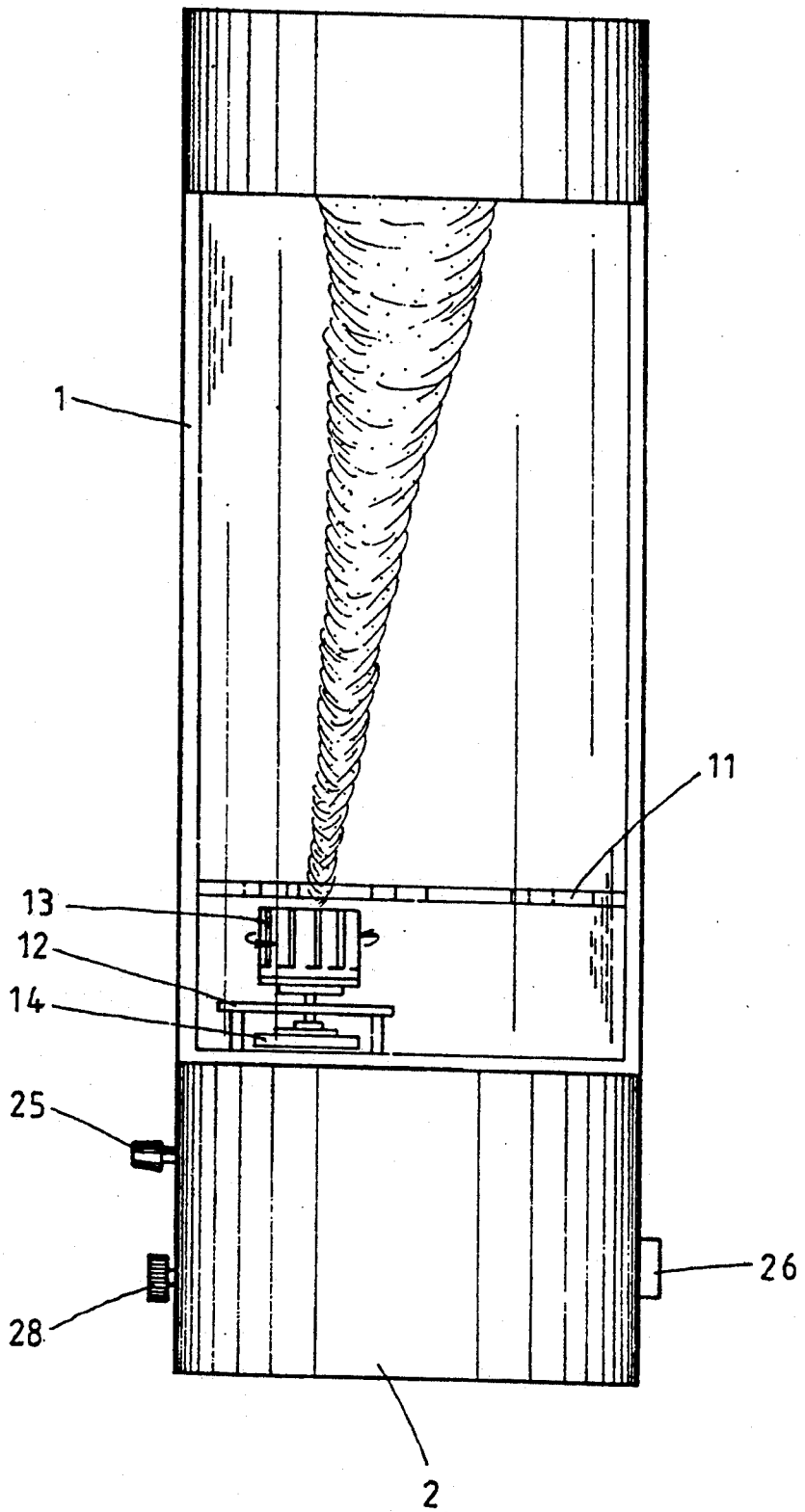

Please refer to FIG. 3 once again, the bi-liquid charged inside the vessel (1) will be drawn and driven to rotate to form a vortex by centrifugal impeller (13) while impeller (13) is rotating. The formation of the vortex is influenced by the speed of the centrifugal impeller (13); the tail end of the vortex is far from the partition board (1) if impeller rotate at low speed as shown on FIG. 4, and the tail end of the vortex will be sucked into the impeller (13) if centrifugal impeller rotates at high speed. Once the liquid possessing light specific gravity is sucked into the impeller, it will then be discharged from discharge outlets (112) located on the partition board (11) in a ball-shaped drop liquid form piece by piece as shown in FIG. 5. The tail end of the vortex will be positioned just about the upper part of the partition board (11); very close to the suction intake of the impeller; if the impeller (13) speed is suitably selected as shown on FIG. 6, this is the best status.

We can adjust the variable resistance (28) to control the speed of motor and the speed of the centrifugal impeller.

Figure 7:
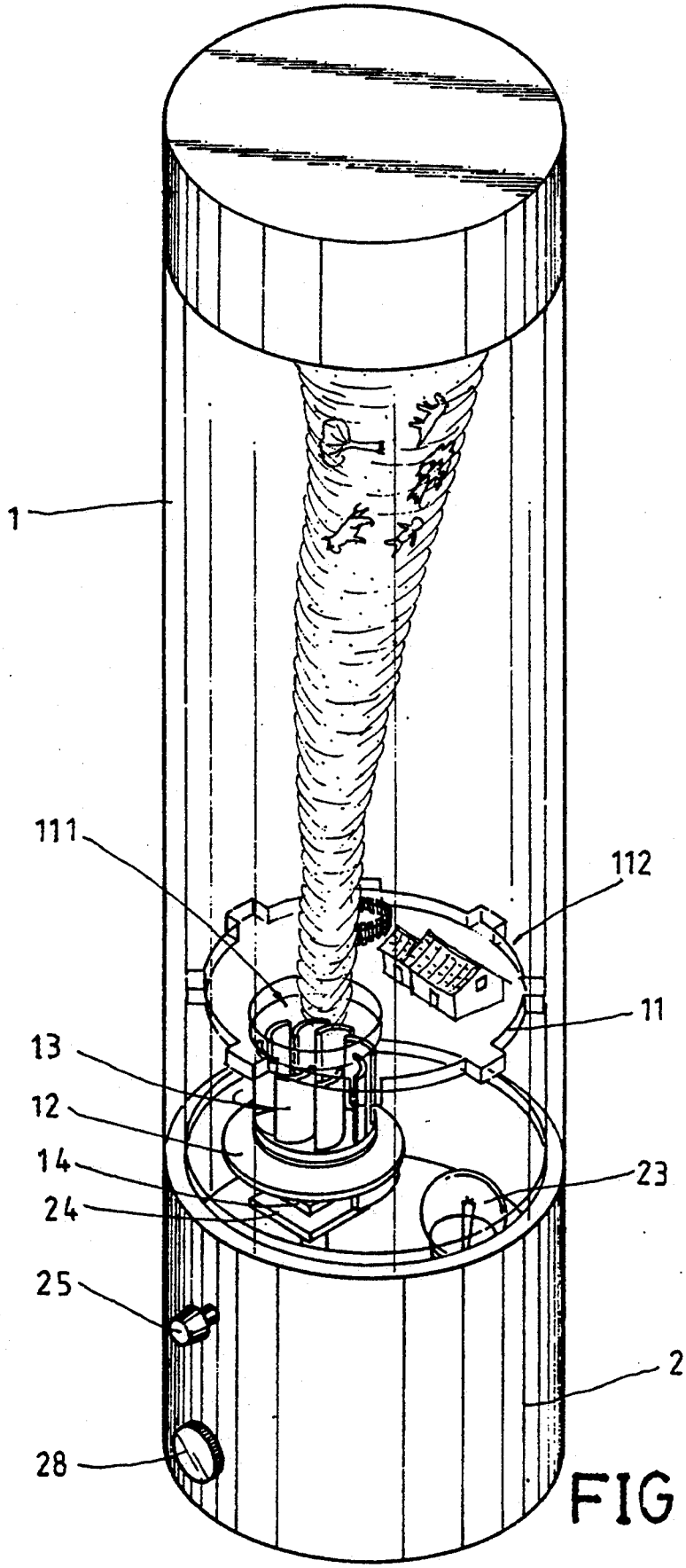
Figure 8:
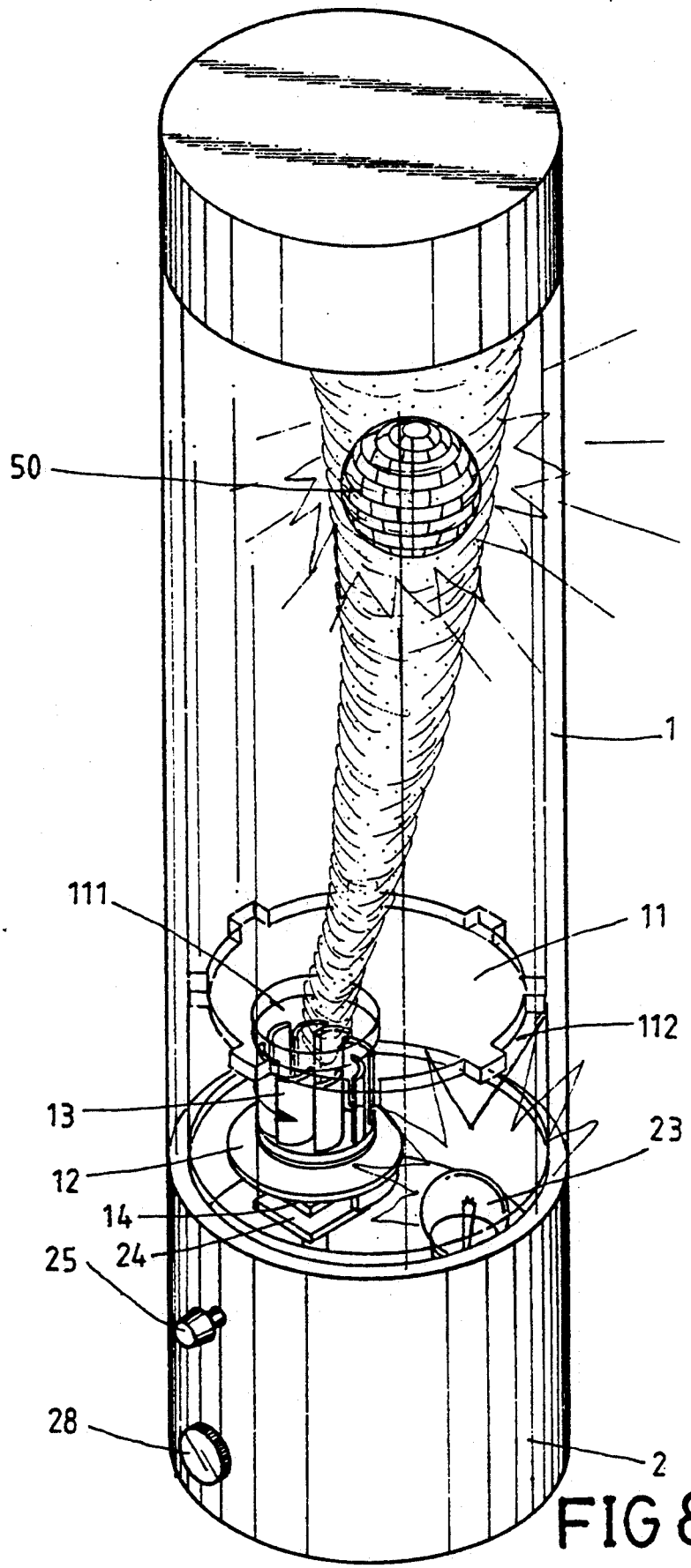

A floating object can be placed inside the transparent vessel (1) as shown on FIG. 7; for example, an animal-shaped object. The size of the floating object must be properly sized to pass through the suction intake (111) and discharge outlet (112) located on the partition board and the space between any two impeller blades of the centrifugal impeller (13). Ornament items like a farming house, fence, tree, etc. articles can be placed on the partition board (11). The animal-shaped floating object and the ornament item - farming land will be swallowed by the vortex as if they were really attacked by a cyclone as shown on FIG. 7. Furthermoare, we place a light-reflecting ball inside the vessel (1); and the ball is heavy to keep it at a constant direction. The light-reflecting ball will be caused to rotate by the vortex; at this moment, the light bulb (23) installed on the base seat (2) will emit light and project light on the ball (50); consequently ball (50) will reflect the light emitted by light bulb (23) as if they were the stage lights sparkling in a ball room. The light bulb (23) can be a condensing light bulb or a common light bulb with condensing lens to project light on the reflecting ball (50).

I claim:

1. A cyclonic liquid ornament comprising:
a) a transparent vessel;
b) two liquids of different specific gravities contained within the vessel;
c) a centrifugal impeller for creating a vortex from the liquid of lesser specific gravity to simulate a cyclone formation within the vessel; and
d) a light-reflecting ball within the vessel and means for directing light onto the ball.

2. The ornament of claim 1 further including:
a) a base supporting the vessel;
b) drive means contained within the base for rotating the centrifugal impeller.

3. The liquid ornament of claim 1 wherein the liquid of lesser specific gravity is dyed.

4. The liquid ornament of claim 1 further including at least one floating ornament within the vessel.

5. A cyclonic liquid ornament comprising:
a) a transparent vessel;
b) two liquids of different specific gravities contained within the vessel;
c) a centrifugal impeller for creating a vortex from the liquid of lesser specific gravity to simulate a cyclone formation within the vessel;
d) a base supporting the vessel;
e) drive means contained within the base for rotating the centrifugal impeller;
f) a partition board disposed within the vessel and positioned above the centrifugal impeller, the partition board including a suction intake eccentrically offset from a central axis of the vessel and a plurality of peripheral discharge outlets;
g) the impeller being positioned below the suction intake and including a first half of a magnetic drive assembly;
h) the drive means including a second half of a magnetic drive assembly and a motor for rotating same; and
j) means for varying the speed of the motor.

6. The liquid ornament of claim 5 wherein the liquid of lesser specific gravity is dyed.

7. The liquid ornament of claim 5 further including at least one floating ornament within the vessel.

8. The ornament of claim 5 further including a light-reflecting ball within the vessel and means for directing light onto the ball.

* * * * *